United States Patent [19]

Suroff

[11] 4,417,737

[45] Nov. 29, 1983

[54] SELF-PROPELLED ROLLER SKATE

[76] Inventor: Hyman Suroff, 6813 21st Ave., Brooklyn, N.Y. 11204

[21] Appl. No.: 416,925

[22] Filed: Sep. 13, 1982

[51] Int. Cl.[3] ..... A63C 17/12

[52] U.S. Cl. ..... 280/11.115; 280/11.2

[58] Field of Search ..... 280/11.115, 11.27, 11.28, 280/11.19, 226 R, 226 A, 220, 254, 11.2

[56] References Cited

U.S. PATENT DOCUMENTS

| | | | |
|---|---|---|---|
| 687,878 | 12/1901 | Glade | 280/11.115 |
| 732,120 | 6/1903 | Schmidt | 280/11.115 |
| 936,173 | 10/1909 | Schoenberg | 280/11.115 |
| 1,050,490 | 1/1913 | Schwarz | 280/11.2 |
| 1,066,842 | 7/1913 | Post | 280/11.115 |
| 1,421,532 | 7/1922 | Muck | 280/11.2 |
| 1,784,761 | 12/1930 | Smith | 280/11.115 |
| 3,112,119 | 11/1963 | Sweet | 280/11.2 |

*Primary Examiner*—David M. Mitchell
*Attorney, Agent, or Firm*—Leonard W. Suroff

[57] ABSTRACT

A self-propelled roller skate requiring a minimum of energy of the wearer thereof includes an articulated frame having a front portion, which includes the propelling mechanism, and a rear portion, which includes a standing and braking apparatus. The propulsion of the roller skate is accomplished by the wearing individual merely raising the front portion of his foot and shifting his body weight to the heel of the same foot or to the opposite foot. Upon placing the raised foot or portion upon a flat surface and shifting his weight back to that foot or portion, propulsion is accomplished without requiring any additional physical energy.

11 Claims, 8 Drawing Figures

FIG. 1
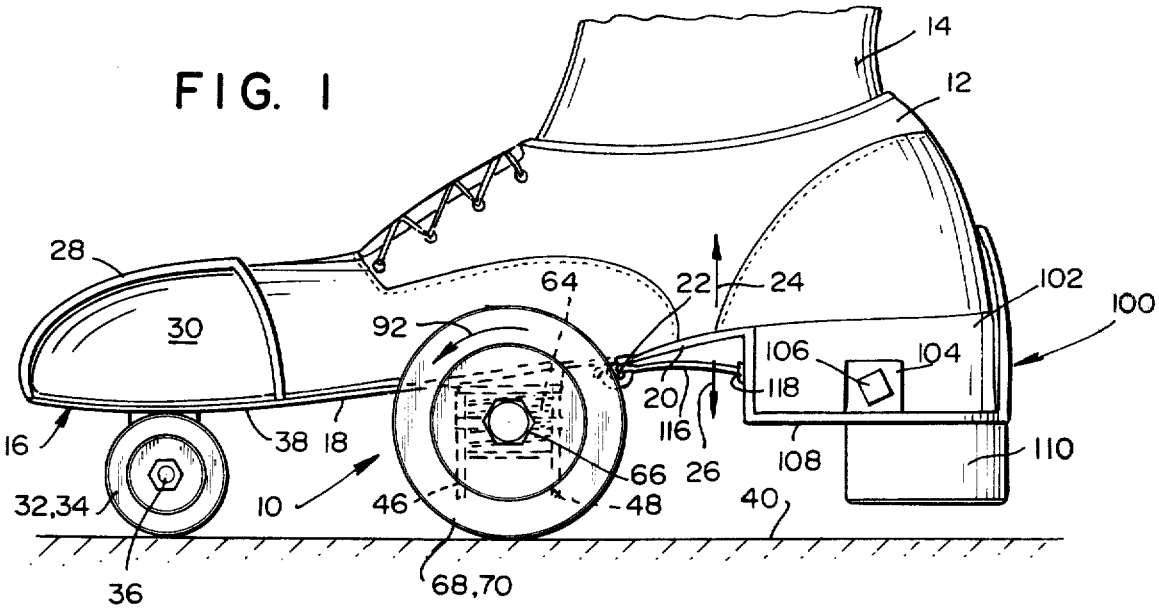
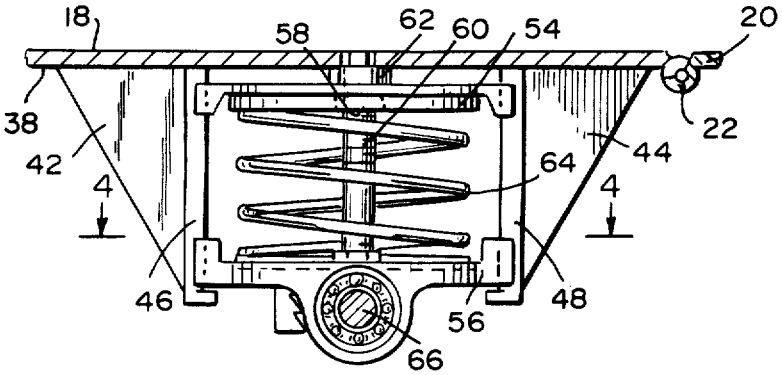
FIG. 2
FIG. 3
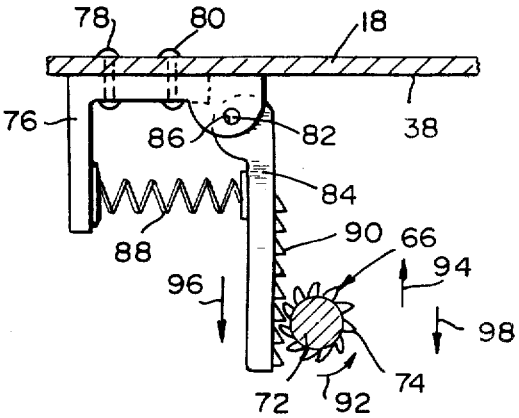
FIG. 4
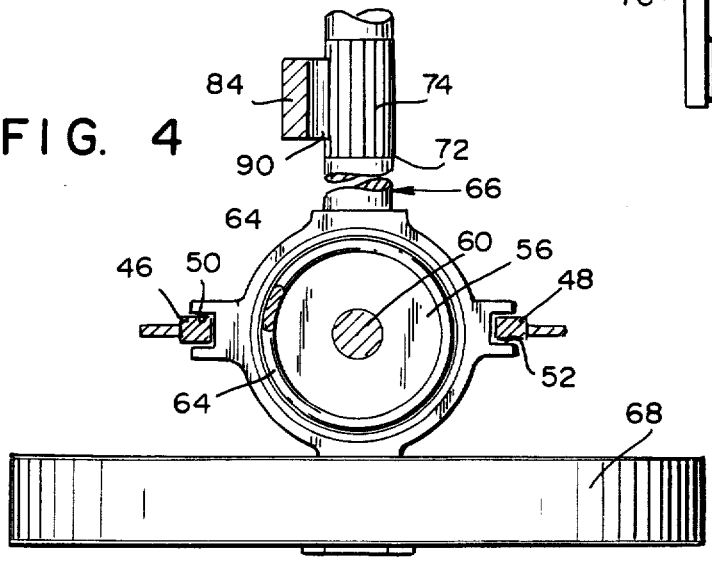

FIG. 5
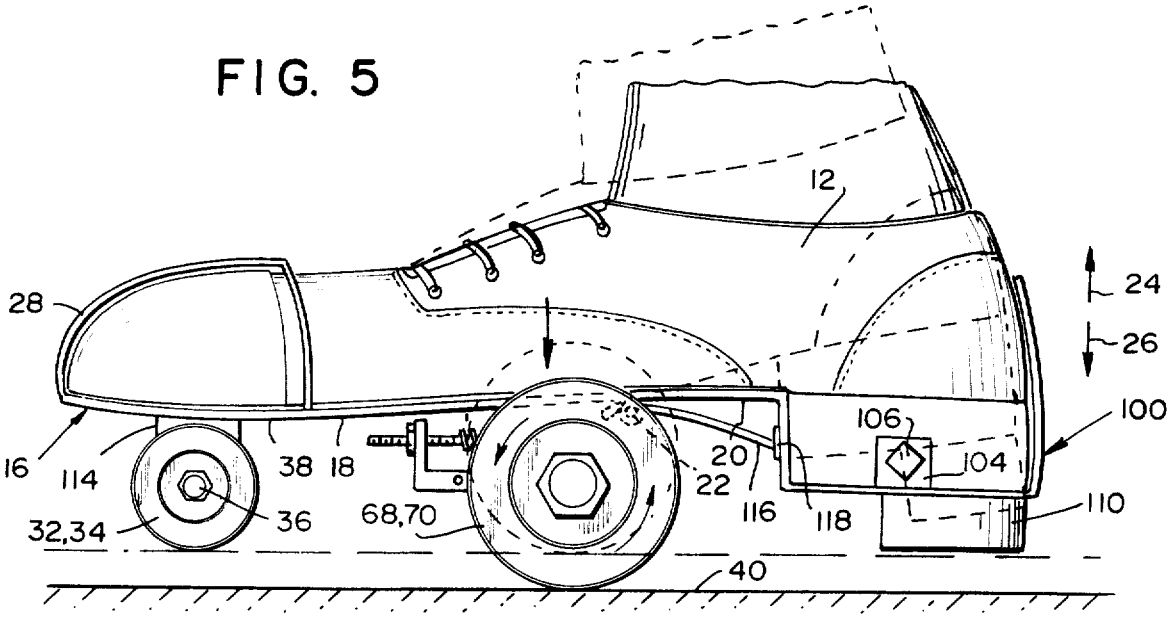
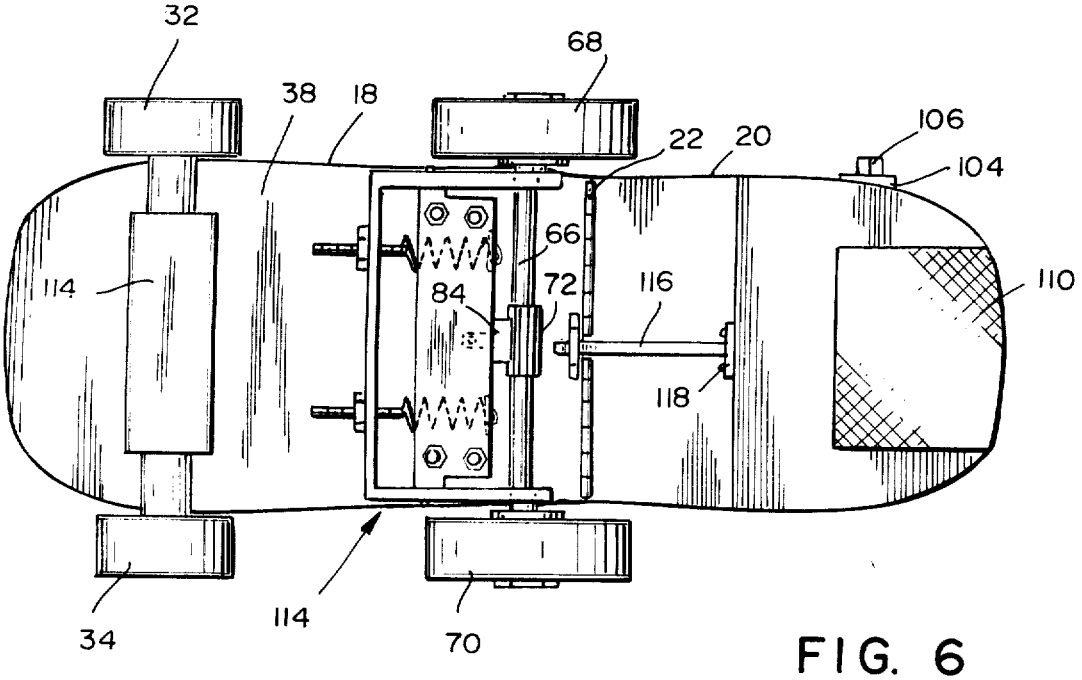
FIG. 6

FIG. 7
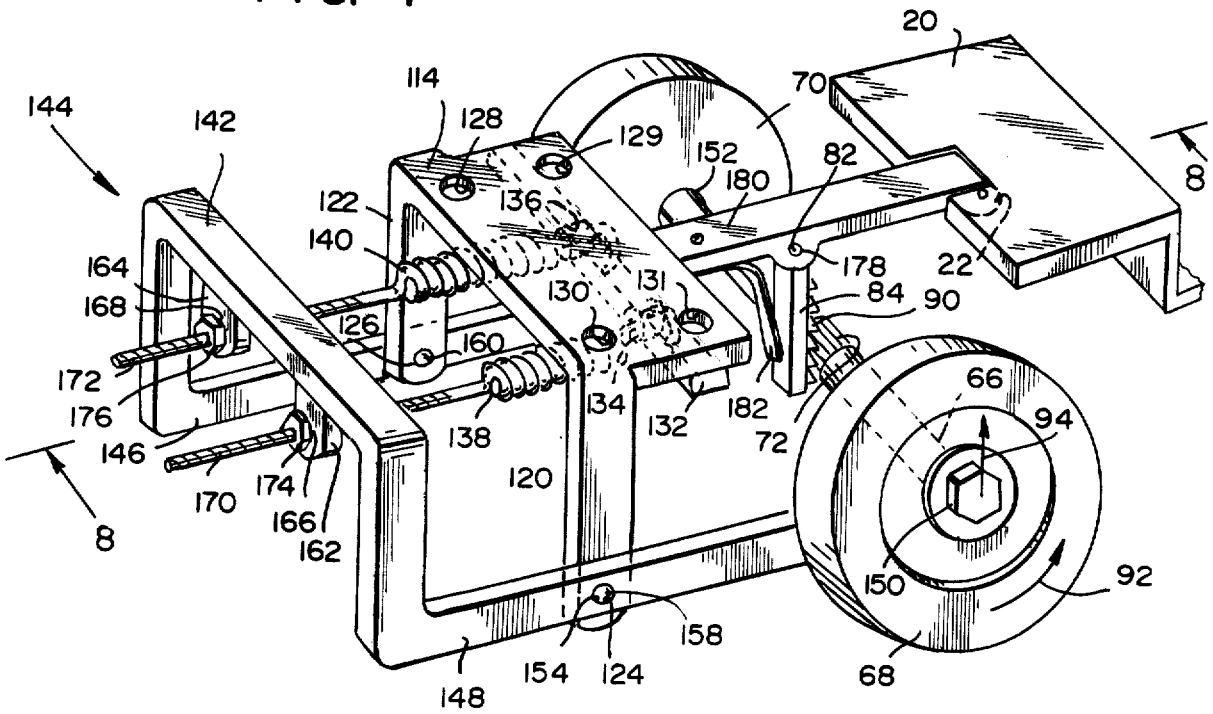
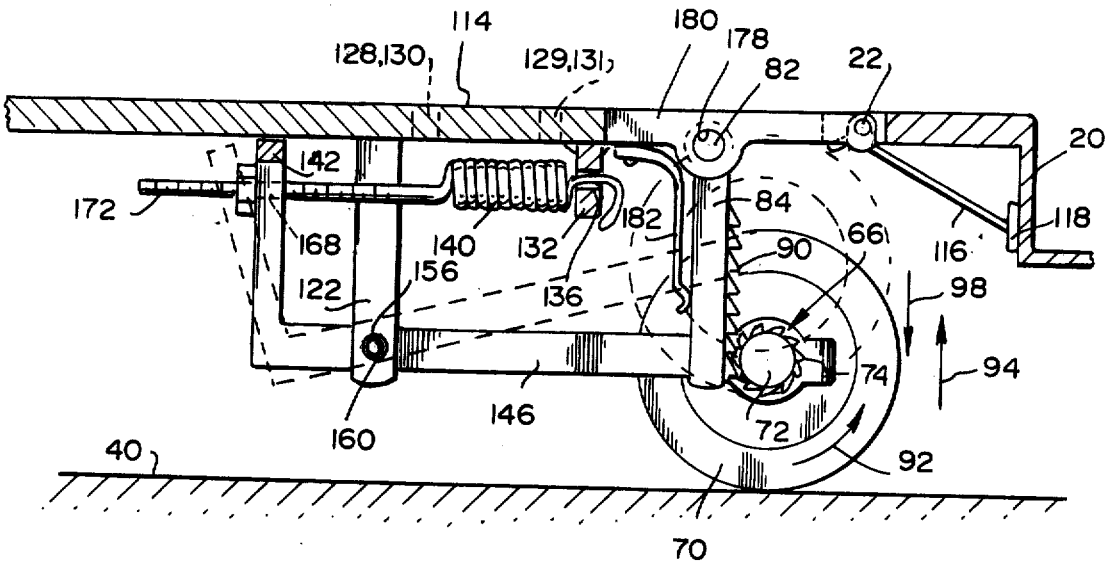
FIG. 8

SELF-PROPELLED ROLLER SKATE

BACKGROUND OF THE INVENTION

1. Field of the Invention

The present invention relates to roller skates, and in particular, relates to self propelled roller skates requiring no additional energy from the user thereof other than the shifting of his own body weight and alternately raising the front portion of his foot small amounts.

2. Description of the Relevant Art

Various types of roller skates are known in the art, all of which have been suggested by inventors for use by individuals to help them engage in more rapid movement along a flat surface while expending relatively small amounts of energy. Typical of these roller skates is U.S. Pat. No. 3,112,119 issued to C. M. Sweet on Nov. 26, 1963. The device disclosed therein utilizes an articulated frame mechanism with a plurality of wheels on the front portion of the skate and a braking portion provided by the heel portion. The user of the skates can adjust his weight to accomplish braking, by leaning backwardly (putting the weight on the shoe heels) or by leaning in a forwardly direction, the weight is placed on the rotating wheels thereby providing movement over a flat surface. However, with this type of device, it is necessary that the wearer of the roller skate use large amounts of energy to obtain movement through a movement commonly referred to as "pumping" wherein one foot of the individual is used to push while the weight of the body is placed on the wheel portion of the skate. This pumping action is repeated alternately between feet, obtaining locomotion on a flat surface. Relatively large amounts of energy are required to obtain movement.

Another type of roller or shoe skate is disclosed in U.S. Pat. No. 3,983,643 issued to W. Schreyer et al on Oct. 5, 1976. The apparatus disclosed therein relates to a shoe which may be utilized for walking or roller skating wherein the roller skating apparatus is contained within the sole of the shoe and may be used for either walking or roller skating. Hereagain, once the roller skating mode is selected, the pumping action is required to get locomotion along a flat surface.

Therefore, it is an object of the present invention to overcome the shortcomings known in the prior art by providing a simple roller skating mechanism which can obtain locomotion by merely shifting the wearer's weight from the front portion of one foot to the rear portion of the same foot or from one foot to the other without expending additional energy in a pumping motion.

It is another object of the present invention to provide a reliable and simple roller skate that may be utilized by young as well as old persons for locomotion since minimal amounts of energy are required.

It is still another object of the present invention to provide a roller skate which achieves locomotion without requiring pumping by the individual wearing them.

It is still another object of the present invention to provide a roller skate which can provide a braking mode so that a more stable and secure operation is obtained.

It is yet another object of the present invention to provide a roller skate which may be worn by an individual without the fear of falling because of a lack of means to stop the skate.

The foregoing and other objects and advantages will appear from the description to follow. In the description reference is made to the accompanying drawing which forms a part hereof, and in which there is shown, by way of illustration, specific embodiments in which the invention may be practiced. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

SUMMARY OF THE INVENTION

A self-propelled roller skate according to the principles of the present invention, used for affixment to an individual's shoe comprises as articulated frame having a front portion and a rear portion. The front and rear portions are coupled together by a hinge for providing in the vertical plane therebetween. The front portion includes; a forward toe portion adapted to receive and cooperate with the toe of a shoe removably retaining the shoe toe therein; wheel means affixed to the underside of the forward toe portion; a ratchet rack vertically disposed on the underside of the frame front portion; and a pair of wheels disposed on the distal ends of an axle, the axle has a ratchet gear thereon, and the wheels and axle are spring mounted to the underside of the frame front portion for vertical movement with the ratchet gear in cooperating contact with the teeth of the ratchet rack. The rear portion includes; a heel portion adapted to receive the heel of an individual's shoe; retaining means disposed in the heel portion for removably clamping the heel of the shoe and retaining it therein; and braking material disposed on the underside of the heel portion for coming into contact with the surface upon which the skate is used to provide braking.

A self-propelled roller skate for affixment to an individuals shoe, according to the principles of the present invention comprises an articulated frame having a front portion and a rear portion. The front and rear portions are coupled by a hinge for providing movement in a vertical plane therebetween. The front portion includes a forward toe portion adapted to receive and cooperate with the toe portion of a shoe, removably retaining the shoe toe therein and a pair of wheels affixed to the underside of the toe portion, a ratchet rack is vertically disposed on the underside of the frame front portion. A pair of wheels are disposed on the distal ends of an axle with the axle having a ratchet gear disposed thereon. The wheels and the axle are spring mounted to the underside of the frame front portion for vertical movement. The ratchet gear is disposed in cooperating contact with the teeth of the ratchet rack. The rear portion includes a heel portion adapted to receive the heel of an individual's shoe. Retaining means disposed in the heel portion is provided for removably clamping the shoe heel and holding it therein. A braking material is disposed on the underside of the heel portion for contact with the surface upon which the skate is used in order to provide braking. The subject matter which I regard as my invention is particularly pointed out and distinctly claimed in the concluding portion of the Specification. The invention, itself, however both to organization and the method of operation, together with further obvious advantages thereof, may best be understood by reference to the following description taken in connection with the accompanying drawing wherein like reference characters refer to like elements.

BRIEF DESCRIPTION OF THE DRAWING

In order that the invention may be more fully understood, it will now be described, by way of example, with reference to the accompanying drawing, in which:

FIG. 1 is a pictorial representation of a self-propelled roller skate affixed to an individual's shoe, according to the principles of the present invention;

FIG. 2 is an enlarged partial view in elevation of a portion of the embodiment shown in FIG. 1;

FIG. 3 is an enlarged partial view of another portion of the embodiment disclosed in FIG. 1;

FIG. 4 is a cross-sectional view of the embodiment disclosed in FIG. 2 taken along the line 4—4;

FIG. 5 is a pictorial representation of another embodiment of a self-propelled roller skate, according to the principles of the present invention, having an individual's shoe affixed thereon;

FIG. 6 is a bottom view of the embodiment disclosed in FIG. 5;

FIG. 7 is an enlarged isometric representation of a portion of the embodiment disclosed in FIGS. 5 and 6; and FIG. 8 is an enlarged view in elevation taken along the line 8—8 of FIG. 7.

DESCRIPTION OF THE PREFERRED EMBODIMENT

Referring now to the figures, and in particular to FIG. 1, there is shown a self-propelled roller skate 10 affixed to the underside of a shoe 12 worn by an individual 14 desirous of obtaining mobility with a minimum of effort. The roller skate 10 includes an articulated frame 16, having a front portion 18 and a rear portion 20 coupled together by a hinge 22 thereby permitting the rear portion 20 to move relative to the front portion in the direction of arrows 24 and 26 as will be explained hereinafter.

The front portion 18 includes a forward toe portion 28 which is curved and adapted to receive the toe portion 30 of a shoe worn by an individual. The underside of the frame 16 is preferably provided with a pair of wheels 32 and 34, provided on an axle 36, affixed to the underside 38 of the front portion 18 of the skate frame 16, and are freely rotatable when in contact with a surface 40 upon which said skate is utilized.

Affixed to the underside 38 of the front portion 18 is a pair of vertically disposed frame members 42 and 44, which are spaced apart with the frame member 44 being more rearward and positioned proximate the hinge 22 provided on the rear distal end of the front portion 18. Frame members 42 and 44 are provided with oppositely disposed channel guides 46 and 48 which are adapted to cooperate with channels 50 and 52 provided in upper and lower disk members 54 and 56 (see FIG. 4). Upper disk member 54 is provided with a centrally disposed aperture 58 through which a threaded shaft 60 may be received. Shaft 60 is affixed to the underside 38 of frame 16 in a conventional manner with a threaded nut 62 disposed therebetween. Movement of nut 62 along the threaded shaft 60 permits the position, in the vertical direction, of upper disk 54 to be moved in a vertical direction, the reason for which will be disclosed shortly. A coil spring 64 surrounds threaded shaft 60 and is disposed between upper disk member 54 and lower disk member 56. Movement of nut 62 therefore, can adjust tension appearing on coil spring 64.

The lower disk member 56 is provided with a rotatably mounted axle 66 on the underside thereof. Preferably, the axle is housed in ball bearings and is disposed transverse to the longitudinal axis of the front portion 18 of the frame 16. The distal ends of axle 66 are provided with a pair of wheels 68 and 70 rigidly affixed thereon. Disposed upon axle 66 and displaced from the coil spring 64 is a ratchet gear 72 having teeth 74 formed from the axle 66 (see FIG. 4).

An L-shaped bracket 76 is affixed to the underside 38 of the front portion 18 of frame 16 by means of rivets 78 and 80 and includes a pivot pin 82 which retains a vertically disposed ratchet rack 84 having an aperture 86 provided on one distal end. The ratchet rack 84 is freely movable about pivot pin 82 and is urged in a rearward direction by a coil spring 88 disposed between the vertical portion of the L-shaped bracket 76 and the vertically disposed ratchet rack 84 urging it in a rearwardly direction so that the teeth 90 provided thereon may come into contact and cooperate with the teeth 74 provided on the ratchet gear 72. The teeth 90 provided on the ratchet rack 84 will cause the axle 66 to rotate in the direction of arrow 92 whenever axle 66 is permitted to move in an upwardly or vertical direction as shown by arrow 94. Thus, movement of axle 66 in an upwardly direction (arrow 94) while movement of the ratchet rack 84 in a downwardly direction (arrow 96) will cause rotation of axle 66 in the direction of arrow 92. Coil spring 64 normally urges axle 66 in a downwardly direction (arrow 98) thus causing the axle to move to the distal or extreme end of the ratchet rack 84.

The rear portion 20 of frame 16 includes a heel portion 100 adapted to receive the heel portion 102 of an individual's shoe. An upwardly extending bracket 104 may include a threaded screw 106 which may be tightened to retain the heel portion 102 of the individual's shoe in position during use of the self-propelled roller skate 10. Conventionally affixed on the underside 108 of heel portion 100 is a braking material 110, which may be fabricated from rubber, asbestos, or any other material which may be suitable for braking on the surface upon which the skate is to be used.

In operation, a skate 10 is placed on each foot of the user. By either raising one foot or the other, spring 64 will urge axle 66 in a downward direction thereby moving axle 66 to the distal end of ratchet rack 84. This may be accomplished by either raising one's foot slightly or by shifting the individual's weight to the rear portion 20 of the frame 16 resting on the braking material 110 and thus raising the front portion 18 of the frame out of contact with the surface 40 upon which the skate is to be used. By repeatedly shifting the weight of the individual alternately between one foot and the other, or from one heel to one toe and then to the other foot in the same manner, the axle 66 is moved to its initial or starting position each time. By stepping down on the front portion 18 of the frame 16, the axle and wheels together therewith are urged in an upwardly direction (direction of arrow 94) and caused to rotate by the teeth 90 of ratchet rack 84 cooperating with the teeth 74 of ratchet gear 72 cooperating therewith, thereby providing rotary motion in the direction of arrow 92 of the wheels 68 and 70 propelling an individual in a forward direction along the surface. The gait utilized by the individual can be either what is known as a waddling motion, moving from side to side, or a heel-toe motion.

Both movements will propel an individual along the surface with a minimum of energy being expended, utilizing only the individual's weight to provide the energy for propulsion.

Referring now to FIG. 5 in which there is shown an alternative embodiment of the subject invention wherein like referenced characters refer to like elements. The self-propelled rollerskate 112 disclosed in FIG. 5 includes an articulated frame 16 having a front portion 18 and a rear portion 20 similar to that disclosed in FIG. 1, including a front wheel axle 36 and wheels 32 and 34 affixed to the underside 38 of the front portion 18 by means of a support bracket 114 in a conventional manner. Wheels 32 and 34 are permitted to freely rotate as disclosed earlier. The rear portion 20 of frame 16 is hingedly affixed to the front portion 18 by means of a hinge 22, thus permitting the rear portion 20 to move in a generally vertical direction as shown by arrows 24 and 26. A bracket 104 is provided on the heel portion 100 and contains an adjustment screw 106 adapted to retain an individual's shoe 12 in the same manner as disclosed in the earlier embodiment. The toe portion of shoe 12 is retained in the front portion 18 of frame 16 similarly.

FIG. 6 is a view of the underside of the frame 16 and discloses the location of the driving mechanism for the alternative embodiment of the self-propelled roller skate 12, wherein the driving mechanism is disposed in the central, generally horizontal section 114 of the front portion 18 of the articulated frame 16. The hinge 22 connecting the front portion 18 to the rear portion 20 includes a leaf spring member 116 having one end affixed to the front portion 18 and retained by a detent 118 to insure that the rear portion 20 is urged in an upwardly direction until the weight of an individual is moved to the heel portion of his shoe. The remaining features of the heel portion 100 are identical to the construction described with the first embodiment.

Referring now to the figures, and in particular to FIG. 1, there is shown a self-propelled roller skate 10 affixed to the underside of a shoe 12 worn by an individual 14 desirous of obtaining mobility with a minimum of effort. The roller skate 10 includes an articulated frame 16, having a front portion 18 and a rear portion 20 coupled together by a hinge 22 thereby permitting the rear portion 20 to move relative to the front portion in the direction of arrows 24 and 26 as will be explained hereinafter.

The front portion 18 includes a forward toe portion 28 which is curved and adapted to receive the toe portion 30 of a shoe worn by an individual. The underside of the frame 16 is preferably provided with a pair of wheels 32 and 34, provided on an axle 36, affixed to the underside 38 of the front portion 18 of the skate frame 16, and are freely rotatable when in contact with a surface 40 upon which said skate is utilized.

Affixed to the underside 38 of the front portion 18 is a pair of vertically disposed frame members 42 and 44, which are spaced apart with the frame member 44 being more rearward and positioned proximate the hinge 22 provided on the rear distal end of the front portion 18. Frame members 42 and 44 are provided with oppositely disposed channel guides 46 and 48 which are adapted to cooperate with channels 50 and 52 provided in upper and lower disk members 54 and 56 (see FIG. 4). Upper disk member 54 is provided with a centrally disposed aperture 58 through which a threaded shaft 60 may be received. Shaft 60 is affixed to the underside 38 of frame 16 in a conventional manner with a threaded nut 62 disposed therebetween. Movement of nut 62 along the threaded shaft 60 permits the position, in the vertical direction, of upper disk 54 to be moved in a vertical direction, the reason for which will be disclosed shortly. A coil spring 64 surrounds threaded shaft 60 and is disposed between upper disk member 54 and lower disk member 56. Movement of nut 62 therefore, can adjust tension appearing on coil spring 64.

The lower disk member 56 is provided with a rotatably mounted axle 66 on the underside thereof. Preferably, the axle is housed in ball bearings and is disposed transverse to the longitudinal axis of the front portion 18 of the frame 16. The distal ends of axle 66 are provided with a pair of wheels 68 and 70 rigidly affixed thereon. Disposed upon axle 66 and displaced from the coil spring 64 is a ratchet gear 72 having teeth 74 formed from the axle 66 (see FIG. 4).

An L-shaped bracket 76 is affixed to the underside 38 of the front portion 18 of frame 16 by means of rivets 78 and 80 and includes a pivot pin 82 which retains a vertically disposed ratchet rack 84 having an aperture 86 provided on one distal end. The ratchet rack 84 is freely movable about pivot pin 82 and is urged in a rearward direction by a coil spring 88 disposed between the vertical portion of the L-shaped bracket 76 and the vertically disposed ratchet rack 84 urging it in a rearwardly direction so that the teeth 90 provided thereon may come into contact and cooperate with the teeth 74 provided on the ratchet gear 72. The teeth 90 provided on the ratchet rack 84 will cause the axle 66 to rotate in the direction of arrow 92 whenever axle 66 is permitted to move in an upwardly or vertical direction as shown by arrow 94. Thus, movement of axle 66 in an upwardly direction (arrow 94) while movement of the ratchet rack 84 in a downwardly direction (arrow 96) will cause rotation of axle 66 in the direction of arrow 92. Coil spring 64 normally urges axle 66 in a downwardly direction (arrow 98) thus causing the axle to move to the distal or extreme end of the ratchet rack 84.

The rear portion 20 of frame 16 includes a heel portion 100 adapted to receive the heel portion 102 of an individual's shoe. An upwardly extending bracket 104 may include a threaded screw 106 which may be tightened to retain the heel portion 102 of the individual's shoe in position during use of the self-propelled roller skate 10. Conventionally affixed on the underside 108 of heel portion 100 is a braking material 110, which may be fabricated from rubber, asbestos, or any other material which may be suitable for braking on the surface upon which the skate is to be used.

In operation, a skate 10 is placed on each foot of the user. By either raising one foot or the other, spring 64 will urge axle 66 in a downward direction thereby moving axle 66 to the distal end of ratchet rack 84. This may be accomplished by either raising one's foot slightly or by shifting the individual's weight to the rear portion 20 of the frame 16 resting on the braking material 110 and thus raising the front portion 18 of the frame out of contact with the surface 40 upon which the skate is to be used. By repeatedly shifting the weight of the individual alternately between one foot and the other, or from one heel to one toe and then to the other foot in the same manner, the axle 66 is moved to its initial or starting position each time. By stepping down on the front portion 18 of the frame 16, the axle and wheels together therewith are urged in an upwardly direction (direction of arrow 94) and caused to rotate by the teeth 90 of ratchet rack 84 cooperating with the teeth 74 of ratchet gear 72 cooperating therewith, thereby providing rotary motion in the direction of arrow 92 of the wheels 68 and 70 propelling an individual in a forward direction along the surface. The gait utilized by the individual can be either what is known as a waddling motion, moving from side to side, or a heel-toe motion. Both movements will propel an individual along the surface with a minimum of energy being expended, utilizing only the individual's weight to provide the energy for propulsion.

Referring now to FIG. 5 in which there is shown an alternative embodiment of the subject invention wherein like referenced characters refer to like elements. The self-propelled rollerskate 112 disclosed in FIG. 5 includes an articulated frame 16 having a front portion 18 and a rear portion 20 similar to that disclosed in FIG. 1, including a front wheel axle 36 and wheels 32 and 34 affixed to the underside 38 of the front portion 18 by means of a support bracket 114 in a conventional manner. Wheels 32 and 34 are permitted to freely rotate as disclosed earlier. The rear portion 20 of frame 16 is hingedly affixed to the front portion 18 by means of a hinge 22, thus permitting the rear portion 20 to move in a generally vertical direction as shown by arrows 24 and 26. A bracket 104 is provided on the heel portion 100 and contains an adjustment screw 106 adapted to retain an individual's shoe 12 in the same manner as disclosed in the earlier embodiment. The toe portion of shoe 12 is retained in the front portion 18 of frame 16 similarly.

FIG. 6 is a view of the underside of the frame 16 and discloses the location of the driving mechanism for the alternative embodiment of the self-propelled roller skate 12, wherein the driving mechanism is disposed in the central, generally horizontal section 114 of the front portion 18 of the articulated frame 16. The hinge 22 connecting the front portion 18 to the rear portion 20 includes a leaf spring member 116 having one end affixed to the front portion 18 and retained by a detent 118 to insure that the rear portion 20 is urged in an upwardly direction until the weight of an individual is moved to the heel portion of his shoe. The remaining features of the heel portion 100 are identical to the construction described with the first embodiment.

Referring now to FIGS. 6, 7 and 8, wherein there is disclosed enlarged details of the mechanisms set forth in FIGS. 5 and 6. The underside of the central section 114 is provided with a pair of downwardly extending arms 120 and 122 having, at the distal ends, a pair of apertures 124 and 126, respectively, provided therein. A plurality of apertures 128, 129, 130 and 131 are provided on the generally, horizontally disposed central portion 114. These apertures are adapted to receive rivets or nuts and bolts, not shown, which affix the front portion 18 to an individual's shoe or may be utilized with any other suitable means, e.g. plug and socket, shoulder shank and keyhole socket, velcro, etc., to affix the self-propelled mechanism thereto. The underside 38 of the central section 114 is provided with a downwardly extending bracket 132 which has therein a pair of apertures 134 and 136 that function to retain one end of a coil spring 138 and 140, respectively. The other end of coil springs 138 and 140 extend in a forwardly direction towards the base portion 142 of a U-shaped bracket 144 and is provided with arms 146 and 148 that extend rearwardly and are provided with apertures 150 and 152 proximate the distal ends thereof. An additional pair of apertures 154 and 156 are disposed along the length of arms 146 and 148 and are positioned so that they coincide with apertures 124 and 126 provided in arms 120 and 122 of the central section 114 and are adapted to receive pivot pins 158 and 160 therein, thereby providing a pivot point for arms 146 and 148 of U-shaped bracket 144. The base portion 142 of bracket 144 is further provided with a pair of depending ears 162 and 164 which have apertures 166 and 168 provided therein adapted to receive the remaining end of springs 138 and 140 therethrough. The ends 170 and 172 of springs 138 and 140, respectively, are provided with threads thereon and are held in position by a pair of retaining nuts 174 and 176 that may be used to adjust the tension of coil springs 138 and 140 as necessary.

The axle 66 has a pair of wheels 68 and 70 rigidly affixed thereon and is journaled in apertures 150 and 152 provided at the distal end of arms 146 and 148 of U-shaped bracket 144. A ratchet gear 72 is disposed on axle 66 preferably in the central portion thereof.

A ratchet rack 84 extends in a downwardly direction having an aperture provided on one distal end adapted to receive a pivot pin 82 therein. Pivot pin 82 is inserted in aperture 178 provided on the underside of the rearwardly extending section 180 of the front portion 18 of frame 16. A leaf spring 182 is affixed to the underside of the rearwardly extending section 180 and is in intimate contact with ratchet rack 84, urging it in a rearwardly direction to that it comes into intimate contact with the ratchet gear provided on the axle 66 providing cooperative engagement between the teeth 90 appearing on the ratchet rack 84 and the teeth 74 provided on the ratchet gear 72. Movement of the axle 66 and wheels 68 and 70 are in the direction of arrows 94 and 92, respectively, in a manner similar to that described for the earlier embodiment.

By removing the weight of an individual from the front portion 18, the springs 138 and 140 acting upon the base portion 142 of U-shaped bracket 144 urges the axle 66 in the direction of arrow 98, thus moving the axle to the distal end of ratchet rack 84. This may be accomplished by an individual raising his foot off the ground surface 40 or by shifting his weight to the rear portion 20 of the self-propelled roller skate 112 as explained earlier. Movement may be accomplished by either lifting one foot off the surface and then the other in a duck-like fashion or, alternatively, utilizing a heel-toe gait.

The operation of the instant embodiment is exactly the same as the operation of the embodiment disclosed in FIG. 1. The manner of utilizing the self-propelled mechanism relies upon an individual shifting his weight from heel-to-toe alternately between his left and right foot or, as explained earlier, the same priming of the mechanism is accomplished by raising the individual's foot off the walking surface. An individual, after practicing the required movements, can become adept at it and propel along a smooth surface with ease thereby enabling persons unable to raise their feet an ability to be propelled along the surface with a minimum of effort.

Hereinbefore has been disclosed a self-propelled roller skate which may be utilized by individual's having walking problems or unable to expend large amounts of energy. The mechanism is simple, reliable, and readily adaptable to be used with shoes which have been fitted to an individual's foot. It will be understood that various changes in the details, materials, arrangement of parts and operating conditions which have been herein described and illustrated in order to display the nature of the invention may be made by those skilled in the art within the principles and scope of the instant invention.

Having thus set forth the nature of the invention, what is claimed is:

1. A self-propelled roller skate for affixment to an individual's shoe comprising, in combination:

A. an articulated frame having a front portion and a rear portion, said front and rear portions being coupled by a hinge means for providing movement in a vertical plane therebetween, said front portion including:

(i) a forward toe portion adapted to receive and cooperate with the toe of a shoe removably retaining said shoe toe therein, (a) wheel means rotatably affixed to the underside of said forward toe portion;

(ii) a central, generally horizontal section of said toe portion having means thereon for providing affixment to the sole of said shoe, said central section including;

(a) a pair of downwardly extending arms provided with apertures at the distal ends thereof, (b) spring retaining means disposed on the underside of said central section, (c) a rearwardly extending section having said hinge means at one distal end thereof, said rearwardly extending section being provided with pivot means on the underside thereof disposed between the distal ends of said rearwardly extending section, (d) a ratchet rack pivotable in said pivot means and extending downwardly, with the teeth of said rack disposed rearwardly, (e) a first spring means having one end affixed to said underside of said central section with the other end thereof positioned to urge said ratchet rack rearwardly, (f) a generally U-shaped bracket means having a vertically extending base portion and horizontally disposed arm portions, said arm portions being disposed rearwardly and being provided with apertures adapted to cooperate with said apertures provided on said pair of said downwardly extending arms to form a pivot point, said U-shaped bracket base portion being provided with spring retaining means; and B. a rear portion having means to cooperate with the rearwardly extending section of said forward toe portion to form said hinge means; said rear portion further including;

(i) a heel section adapted to receive the heel of an individual's shoe, (ii) retaining means disposed in said heel section for removably clamping the heel of said shoe and retaining it therein, and (iii) braking material disposed on the underside of said heel section for coming into contact with a surface upon which said skate is used, to provide braking; and C. a pair of wheels disposed on the distal ends of an axle, said axle having a centrally disposed ratchet gear thereon, said axle and wheels being rotatably mounted proximate the distal ends of said horizontally disposed arm portion of said U-shaped bracket means with said ratchet gear being in intimate contact with said ratchet rack for cooperation therebetween; and D. a second spring means connected between said U-shaped bracket base portion spring retaining means and said spring retaining means provided on the underside of said central frame section, said second spring means urging said U-shaped bracket base means towards said central frame section, said rack causing said gear and said pair of wheels to rotate in a forward direction on said surface when the weight of said individual is placed on said central frame section.

2. A self-propelled roller skate according to claim 1 wherein said means for affixment to the sole of said shoe includes:

A. a plurality of apertures provided in said frame central section, and

B. mating means provided in the sole of said shoe, said mating means being adapted to be received by said frame central section apertures for rigidly holding said frame central section to said shoe sole.

3. A self-propelled roller skate according to claim 2 wherein said mating means are rivets.

4. A self-propelled roller skate according to claim 1 wherein said frame central section spring retaining means comprises a plurality of apertures provided in a depending downwardly extending portion provided on the underside of said frame central section.

5. A self-propelled roller skate according to claim 1 wherein said first spring means is a generally L-shaped leaf spring, said leaf spring being riveted to the underside of said frame central section proximate the distal end of said spring.

6. A self-propelled roller skate according to claim 1 wherein said U-shaped bracket base portion spring retaining means comprises a depending portion provided with an aperture adapted to receive one end of said second spring means.

7. A self-propelled roller skate according to claim 1 wherein said second spring means comprises a coil spring having one distal end provided with a hook-shaped portion adapted to cooperate with said frame central section spring retaining means and the other distal end is provided with an elongated threaded portion adapted to be received by said U-shaped bracket base portion spring retaining means.

8. A self-propelled roller skate according to claim 7 further including a nut means adapted to cooperate with the threaded second spring means threaded portion to adjust the tension of said second spring means.

9. A self-propelled roller skate according to claim 1 wherein said front portion wheel means includes a pair of wheels rotatably mounted on the distal ends of an axle, said axle being affixed to the underside of said frame front portion.

10. A self-propelled roller skate according to claim 9 wherein said front wheels are provided with ball bearings to permit free rotation about the axle and said rear axle is provided with ball bearings to permit free rotation of said rear axle.

11. A self-propelled roller skate according to claim 1 wherein said frame rear heel section retaining means includes an upwardly extending bracket portion having a threaded aperture disposed therein and a threaded screw adapted to be received in said aperture, said screw being adjustable and capable of retaining the heel portion of said shoe within said rear heel section of said frame.

* * * * *